US010090603B2

(12) United States Patent
Behdad et al.

(10) Patent No.: US 10,090,603 B2
(45) Date of Patent: Oct. 2, 2018

(54) TRUE-TIME DELAY, LOW PASS LENS

(75) Inventors: Nader Behdad, Madison, WI (US); Meng Li, Madison, WI (US)

(73) Assignee: WISCONSIN ALUMNI RESEARCH FOUNDATION, Madison, WI (US)

( * ) Notice: Subject to any disclaimer, the term of this patent is extended or adjusted under 35 U.S.C. 154(b) by 1816 days.

(21) Appl. No.: 13/483,381

(22) Filed: May 30, 2012

(65) Prior Publication Data

US 2013/0322495 A1 Dec. 5, 2013

(51) Int. Cl.

*H01Q 15/02* (2006.01)
*H01Q 15/00* (2006.01)
*H01Q 15/04* (2006.01)

(52) U.S. Cl.

CPC ..... *H01Q 15/0026* (2013.01); *H01Q 15/04* (2013.01)

(58) Field of Classification Search

CPC ... H01Q 15/04; H01Q 15/0026; H01Q 9/0407
USPC ..... 343/753, 909
See application file for complete search history.

(56) References Cited

U.S. PATENT DOCUMENTS

| | | | | |
|---|---|---|---|---|
| 4,381,509 | A | 4/1983 | Rotman et al. | |
| 4,588,994 | A | 5/1986 | Tang et al. | |
| 5,389,939 | A | 2/1995 | Tang et al. | |
| 5,821,908 | A | 10/1998 | Sreenivas | |
| 6,388,616 | B1 | 5/2002 | Zhou | |
| 6,531,989 | B1 * | 3/2003 | Barker et al. | 343/753 |
| 6,911,941 | B2 * | 6/2005 | Tebbe | H01Q 1/38 156/89.11 |
| 7,298,555 | B2 | 11/2007 | Capps | |
| 7,898,480 | B2 | 3/2011 | Ebling et al. | |
| 8,134,511 | B2 | 3/2012 | Koh et al. | |
| 8,743,000 | B2 * | 6/2014 | Gagnon et al. | 343/753 |
| 2004/0017331 | A1 | 1/2004 | Crawford et al. | |
| 2004/0104860 | A1 | 6/2004 | Durham et al. | |
| 2006/0028386 | A1 | 2/2006 | Ebling et al. | |

(Continued)

FOREIGN PATENT DOCUMENTS

| | | | |
|---|---|---|---|
| EP | 2182582 | A1 | 5/2010 |
| EP | 2221919 | A1 | 8/2010 |

(Continued)

OTHER PUBLICATIONS

Rao et al., Measurement Results of an Affordable Hybrid Phased Array Using a Radant Lens, Naval Research Laboratory Memo Report No. 5320--00-8439, May 15, 2000, Washington, D.C.

(Continued)

*Primary Examiner* — Dameon E Levi
*Assistant Examiner* — Hasan Islam
(74) *Attorney, Agent, or Firm* — Bell & Manning, LLC

(57) ABSTRACT

A lens is provided. The lens includes a first two-dimensional (2-D) grid of capacitive patches and a first sheet layer. The first sheet layer includes a dielectric sheet and a second 2-D grid of capacitive patches. The dielectric sheet has a front surface and a back surface. The first 2-D grid of capacitive patches is mounted directly on the back surface of the dielectric sheet, and the second 2-D grid of capacitive patches is mounted directly on the front surface of the dielectric sheet. The first 2-D grid of capacitive patches is aligned with the second 2-D grid of capacitive patches to form a time delay circuit at each grid position of the aligned 2-D grids.

20 Claims, 10 Drawing Sheets

(56) References Cited

U.S. PATENT DOCUMENTS

| | | | | |
|---|---|---|---|---|
| 2008/0055175 | A1 | 3/2008 | Rebeiz et al. | |
| 2008/0088525 | A1 | 4/2008 | Jonathan | |
| 2008/0284668 | A1 | 11/2008 | Justice et al. | |
| 2009/0273527 | A1 | 11/2009 | Behdad | |
| 2010/0033389 | A1 | 2/2010 | Yonak et al. | |
| 2010/0103049 | A1 | 4/2010 | Tabakovic | |
| 2010/0194663 | A1 | 8/2010 | Rothwell et al. | |
| 2010/0207833 | A1 | 8/2010 | Toso et al. | |
| 2010/0220035 | A1 | 9/2010 | Lee et al. | |
| 2010/0225562 | A1 | 9/2010 | Smith | |
| 2010/0283695 | A1 * | 11/2010 | Geterud | 343/753 |
| 2011/0025432 | A1 | 2/2011 | Gagnon et al. | |
| 2011/0175780 | A1 | 7/2011 | Gatti et al. | |
| 2011/0210903 | A1 | 9/2011 | Sarabandi et al. | |
| 2012/0033618 | A1 | 2/2012 | Wallace et al. | |
| 2012/0056787 | A1 | 3/2012 | Tatarnikov et al. | |
| 2012/0076498 | A1 | 3/2012 | Sayeed et al. | |
| 2012/0088459 | A1 | 4/2012 | Neto et al. | |

FOREIGN PATENT DOCUMENTS

| | | | |
|---|---|---|---|
| WO | WO 2007/127955 | A2 | 11/2007 |
| WO | WO 2008/061107 | A2 | 5/2008 |

OTHER PUBLICATIONS

Römisch et al., Multi-Beam Discrete Lens Arrays with Amplitude-Controlled Steering, 2003 IEEE MTT-S International Microwave Symposium Digest, Philadelphia, PA, Jun. 2003, pp. 1669-1672.

Römisch et al., Multibeam Planar Discrete Millimeter-Wave Lens for Fixed-Formation Satellites, 2002 URSI General Assembly Digest, Maastricht, The Netherlands, Aug. 2002.

Abbaspour-Tamijani et al., A planar filter-lens array for millimeter-wave applications, Proceedings of the IEEE International Antennas and Propagation Society International Symposium, vol. 1, Monterey, CA, Jun. 20-25, 2004, pp. 675-678.

International Search Report and Written Opinion received in PCT/US2011/045911, dated Jan. 19, 2012.

Lee et al., Multi-Beam Phased Array Antennas, Jan. 1, 2002, http://www.archive.org/details/nasa_techdoc_20030020930.

Hong et al., Spatial Processing With Lens Antenna Arrays for Direction-of-Arrival Estimation, Proceedings from "International Union of Radio Science" 27th General Assembly, Aug. 17-24, 2002, Maastricht, the Netherlands, http://www.ursi.org/Proceedings/ProcGA02/ursiga02.pdf.

Schoenberg et al., Two-level power combining using a lens amplifier, IEEE Trans. Microwave Theory Techn., Dec. 1994, vol. 42, No. 12, pp. 2480-2485.

Shiroma et al., A quasi-optical receiver with angle diversity, Proceedings of the IEEE International Microwave Symposium, San Francisco, 1996, pp. 1131-1134.

McGrath et al., Planar three-dimensional constrained lenses, IEEE Trans. Antennas Propagat., Jan. 1986, vol. 34, No. 1, pp. 46-50.

Hollung et al., A bi-directional quasi-optical lens amplifier, IEEE Trans. Microwave Theory Techn., Dec. 1997, vol. 45, No. 12, pp. 2352-2357.

Popovic et al., Quasi-optical transmit/receive front ends, IEEE Trans. Microwave Theory Techn., Nov. 1998, vol. 48, No. 11, pp. 1964-1975.

Pozar et al., Flat lens antenna concept using aperture coupled microstrip patches, Electronics Letters, Nov. 7, 1996, vol. 32, No. 23, pp. 2109-2111.

Saleau et al., Quasi axis-symmetric integrated lens antennas: design rules and experimental/manufacturing trade-offs at millimeter-wave frequencies, Microwave and Optical Technology Letters, Jan. 2006, vol. 48, No. 1, pp. 20-29.

Al-Joumayly et al., Slide presentation of "Design of conformal, high-resolution microwave lenses using sub wavelength periodic structures", 2010 IEEE Antennas and Propagation Society/URSI Symposium, Toronto, ON , Jul. 11-17, 2010.

Al-Joumayly et al., Abstract of "Design of conformal, high-resolution microwave lenses using sub wavelength periodic structures", 2010 IEEE Antennas and Propagation Society/URSI Symposium, Toronto, ON, Jul. 11, 2010.

Al-Joumayly et al., Power Point Presentation "Wideband True-Time-Delay Microwave Lenses Using Low-Profile, Sub-Wavelength Periodic Structures", Jul. 2011.

Notice of Allowance issued in U.S. Appl. No. 12/891,887, dated Apr. 25, 2014.

* cited by examiner

TRUE-TIME DELAY, LOW PASS LENS

REFERENCE TO GOVERNMENT RIGHTS

This invention was made with government support under FA9550-11-1-0050 awarded by the Air Force Office of Scientific Research and under 1101146 awarded by the National Science Foundation. The government has certain rights in the invention.

BACKGROUND

A frequency selective surface (FSS) is designed to provide optional frequency filtering in a single medium rather than a restriction to a fixed frequency response. FSSs are surface constructions generally comprised of a periodic array of electrically conductive elements. In order for its structure to affect electromagnetic waves, the FSS has structural features at least as small, and generally significantly smaller than a wavelength of operation based on a frequency of the electromagnetic wave with which the FSS is used. The FSS may be formed of a metamaterial that includes a plurality of inductive-capacitive (LC) cells that are arranged in an array. The array may be planar, and a plurality of arrays may be stacked one upon the other to form a lens. Each cell in the array forms an LC resonator that resonates in response to incident electromagnetic radiation at frequencies which vary as a function of the shape of the LC cell.

SUMMARY

A lens is provided. The lens includes a first two-dimensional (2-D) grid of capacitive patches and a first sheet layer. The first sheet layer includes a dielectric sheet and a second 2-D grid of capacitive patches. The dielectric sheet has a front surface and a back surface. The first 2-D grid of capacitive patches is mounted directly on the back surface of the dielectric sheet, and the second 2-D grid of capacitive patches is mounted directly on the front surface of the dielectric sheet. The first 2-D grid of capacitive patches is aligned with the second 2-D grid of capacitive patches to form a time delay circuit at each grid position of the aligned 2-D grids.

A transmitter is provided that includes a lens and an electromagnetic wave feed element. The lens includes a first two-dimensional (2-D) grid of capacitive patches and a first sheet layer. The first sheet layer includes a dielectric sheet and a second 2-D grid of capacitive patches. The dielectric sheet has a front surface and a back surface. The first 2-D grid of capacitive patches is mounted directly on the back surface of the dielectric sheet, and the second 2-D grid of capacitive patches is mounted directly on the front surface of the dielectric sheet. The first 2-D grid of capacitive patches is aligned with the second 2-D grid of capacitive patches to form a time delay circuit at each grid position of the aligned 2-D grids. The electromagnetic wave feed element is configured to receive a signal, and in response, to radiate a spherical radio wave toward the first 2-D grid of capacitive patches. The time delay circuit at each grid position of the aligned 2-D grids is selected to re-radiate the spherical radio wave in the form of a second radio wave.

A transmitter system is provided that includes a lens, a signal processor, and an electromagnetic wave feed element. The lens includes a first two-dimensional (2-D) grid of capacitive patches and a first sheet layer. The first sheet layer includes a dielectric sheet and a second 2-D grid of capacitive patches. The dielectric sheet has a front surface and a back surface. The first 2-D grid of capacitive patches is mounted directly on the back surface of the dielectric sheet, and the second 2-D grid of capacitive patches is mounted directly on the front surface of the dielectric sheet. The first 2-D grid of capacitive patches is aligned with the second 2-D grid of capacitive patches to form a time delay circuit at each grid position of the aligned 2-D grids. The signal processor is configured to receive a digital data stream and to transform the received digital data stream into an analog signal. The electromagnetic wave feed element is configured to receive the analog signal, and in response, to radiate a spherical radio wave toward the first 2-D grid of capacitive patches. The time delay circuit at each grid position of the aligned 2-D grids is selected to re-radiate the spherical radio wave in the form of a second radio wave.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
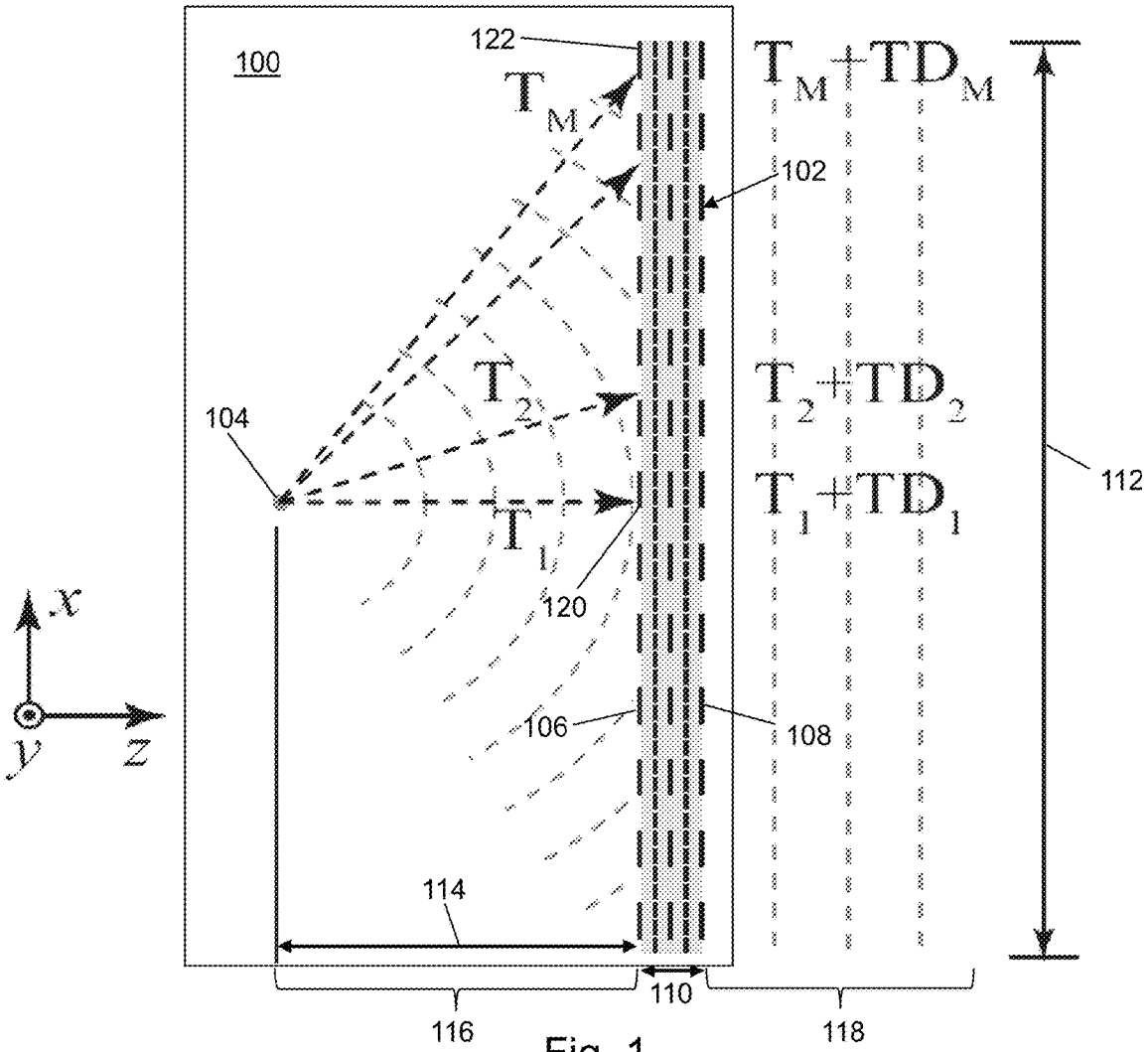
FIG. 1 depicts a one-dimensional (1-D) side view of a transmitter in accordance with an illustrative embodiment.

With reference to FIG. 1, a one-dimensional (1-D) side view of a transmitter 100 is shown in accordance with an illustrative embodiment. Transmitter 100 may include a lens 102 and an electromagnetic wave feed element 104. As known to a person of skill in the art, the wavelength of operation $\lambda_c$ of transmitter 100 is defined as $\lambda_c = c/f_c$, where c is the speed of light and $f_c$ is the carrier frequency. As an example, for $f_c \in [1, 15]$ Gigahertz (GHz), $\lambda_c \in [30,2]$ centimeters (cm).

Lens 102 has a front surface 106 and a back surface 108 and has a thickness 110 between front surface 106 and back surface 108. Lens 102 may be formed of a plurality of frequency selective surface (FSS) layers. Lens 102 further has an aperture length 112. In an illustrative embodiment, lens 102 has a circular aperture. As a result, aperture length 112 is an aperture diameter, D, though a circular aperture is not required.

Electromagnetic wave feed element 104 may be a dipole antenna, a monopole antenna, a helical antenna, a microstrip antenna, a patch antenna, a fractal antenna, a feed horn, a slot antenna, etc. Electromagnetic wave feed element 104 is positioned a focal distance 114, $f_d$, from lens 102. Electromagnetic wave feed element 104 is configured to receive an analog or digital signal, and in response, to radiate a spherical radio wave 116 toward front surface 106 of lens 102. The plurality of FSS layers of lens 102 act as time delay circuits that re-radiate spherical radio wave 116 in the form of a planar wave 118. Though transmitter 100 is described as transmitting electromagnetic waves, as understood by a person of skill in the art, transmitter 100 may be a transceiver and configured to both send and receive electromagnetic waves. Additionally, a receiver system may use a similar architecture as that described with reference to transmitter 100 as understood by a person of skill in the art.

As understood by a person of skill in the art, spherical radio wave 116 reaches different portions of front surface 106 at different times. Lens 102 can be considered to be populated with a plurality of pixels each of which act as a time delay unit by providing a selected time delay within the frequency band of interest. Given aperture length 112 and focal distance 114, the time delay profile provided for lens 102 to form planar wave 118 can be calculated.

Figure 2:
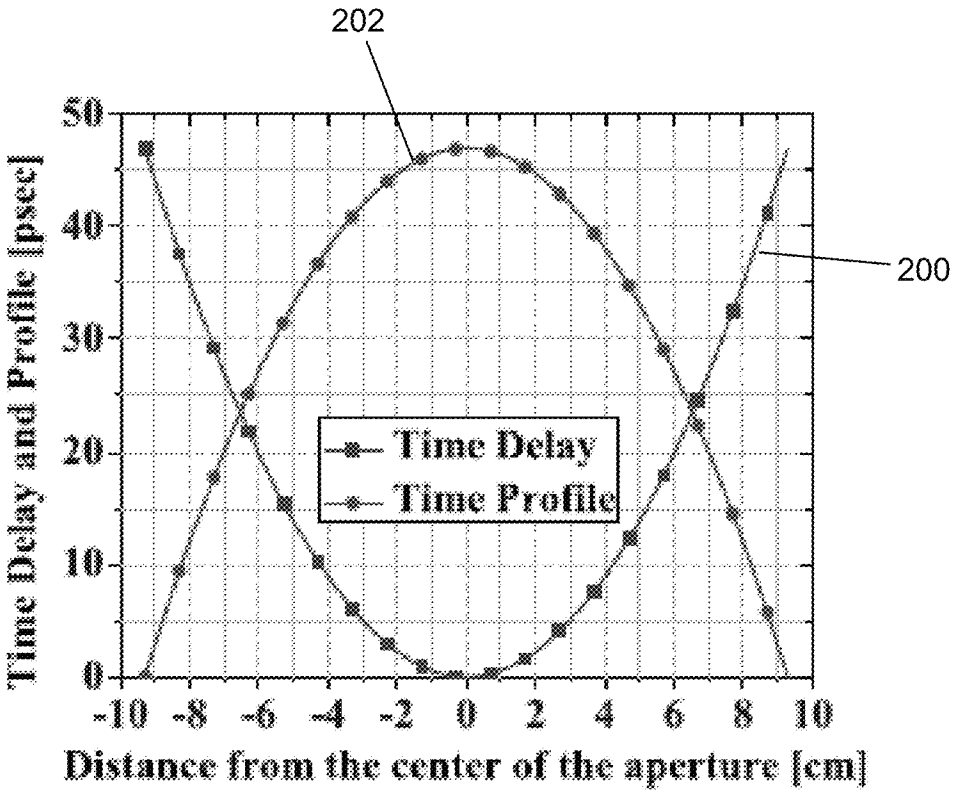
FIG. 2 depicts a time delay profile of a center mounted feed element of the transmitter of FIG. 1 in accordance with an illustrative embodiment.

For example, as shown with reference to FIG. 2, assuming electromagnetic wave feed element 104 is aligned to emit spherical radio wave 116 at the focal point of lens 102, the time it takes for each ray to arrive at front surface 106 of lens 102 is determined by the length of each ray trace, i.e., the distance traveled by the electromagnetic wave traveling at the speed of light. The minimum time corresponds to the propagation time of the shortest ray trace, which is the line path from electromagnetic wave feed element 104 to a center 120 of front surface 106 of lens 102. The maximum time corresponds to the propagation time of the longest ray trace, which is the line path from electromagnetic wave feed element 104 to an edge 122 of front surface 106 of lens 102.

The resulting time delay across front surface 106 of lens 102 for an aperture length 112 of 18.6 cm and a focal distance 114 of 30 cm is shown as a time delay curve 200 in FIG. 2. Time delay curve 200 indicates the excess free-space time delay for a ray arriving at an arbitrary point on front surface 106 of lens 102 between center 120 and edge 122 of front surface 106 of lens 102. To achieve beam collimation, or form planar wave 118, lens 102 is configured as a two-dimensional (2-D) array of time delay elements that provide the reverse time delay profile as indicated by a time profile curve 202. Time profile curve 202 has a minimum value, zero, at edge 122 of front surface 106 of lens 102, and increases to a maximum value at center 120 of front surface 106 of lens 102. The maximum value can be calculated as $$\left(\sqrt{\left(\frac{D}{2}\right)^2 + f_d^2} - f_d\right)\Big/ c.$$

Of course, a fixed time delay can be added to each time delay element of lens 102. Thus, time profile curve 202 is merely an illustrative configuration. Additionally, each time delay element of lens 102 can be configured to generate different time delay profiles that form correspondingly different output waves. For example, each time delay element of lens 102 can be configured such that lens 102 acts as a concave lens. Thus, any other time delay profile can be generated as needed based on the particular design goals for transmitter 100.

Figure 3:
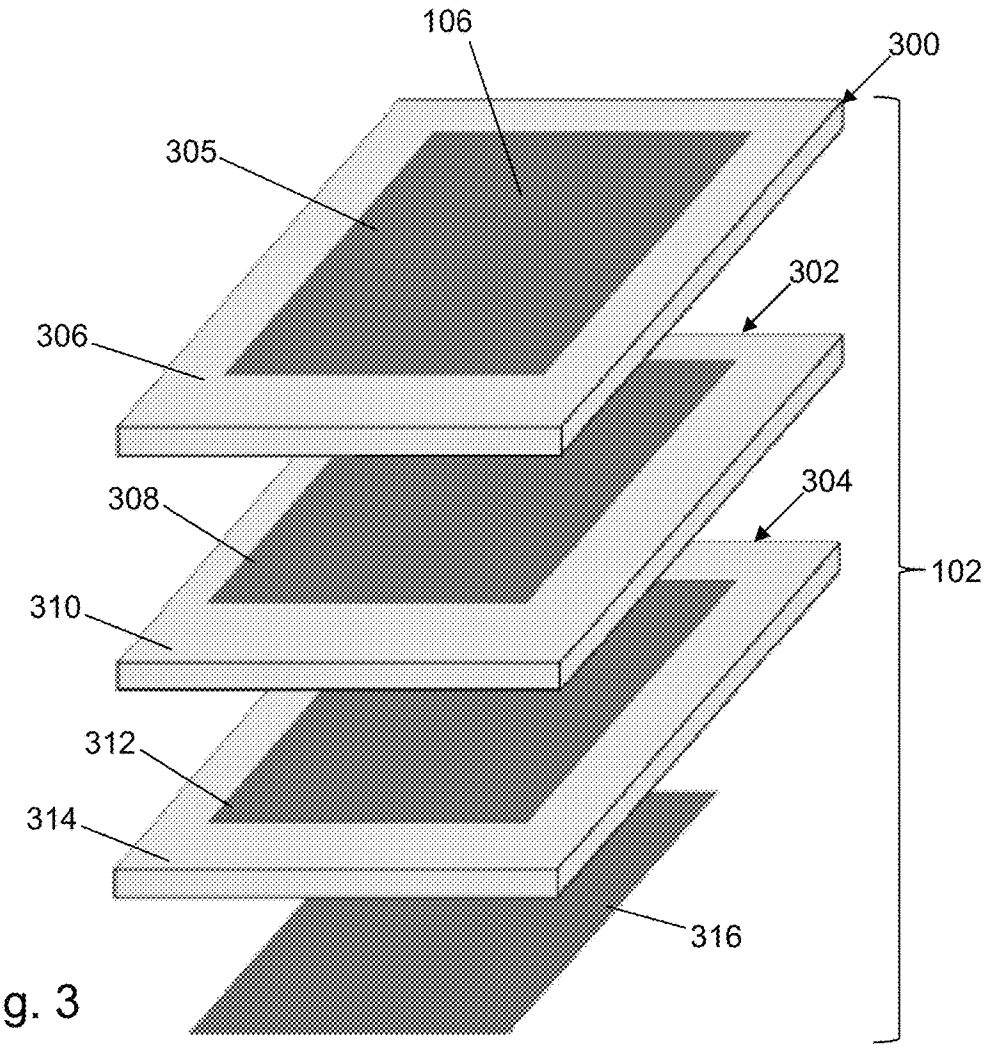
FIG. 3 depicts a lens structure of the transmitter of FIG. 1 in accordance with an illustrative embodiment.

With reference to FIG. 3, lens 102 is shown in accordance with an illustrative embodiment. In the illustrative embodiment, lens 102 includes a first sheet layer 300, a second sheet layer 302, a third sheet layer 304, and a first 2-D grid of capacitive patches 316. In alternative embodiments, lens 102 may include a fewer or a greater number of sheet layers. Lens 102 may be circular, elliptical, or polygonal in shape. First sheet layer 300 includes a second 2-D grid of capacitive patches 305 and a first dielectric sheet 306. Second sheet layer 302 includes a third 2-D grid of capacitive patches 308 and a second dielectric sheet 310. Third sheet layer 304 includes a fourth 2-D grid of capacitive patches 312 and a third dielectric sheet 314. Each dielectric sheet has a front surface and a back surface. Each 2-D grid of capacitive patches has a front surface and a back surface. Front surface 106 of lens 102 corresponds to the front surface of second 2-D grid of capacitive patches 305. Back surface 108 corresponds to the back surface of first 2-D grid of capacitive patches 316.

The back surface of second 2-D grid of capacitive patches 305 is mounted directly on the front surface of first dielectric sheet 306. The front surface of first 2-D grid of capacitive patches 316 is mounted directly on the back surface of third dielectric sheet 314. Third 2-D grid of capacitive patches 308 is mounted directly on the front surface of second dielectric sheet 310 and directly on the back surface of first dielectric sheet 306. Fourth 2-D grid of capacitive patches 312 is mounted directly on the front surface of third dielectric sheet 314 and directly on the back surface of second dielectric sheet 310. Thus, lens 102 is formed as a multi-layered frequency selective surface composed of a number of closely spaced metallic layers (2-D grids of capacitive patches) separated from one another by dielectric substrates (dielectric sheets). Each metallic layer is in the form of a 2-D periodic arrangement of sub-wavelength capacitive patches. For example, lens 102 may be formed by bonding different dielectric substrates together using a bonding film such as a prepreg, which is a reinforcement material pre-impregnated with a polymer or resin matrix in a controlled ratio. Thermosetting polymers/resins solidify by cross-linking to create a permanent network of polymer chains as understood by a person of skill in the art.

As used in this disclosure, the term "mount" includes join, unite, connect, associate, insert, hang, hold, affix, attach, fasten, bind, paste, secure, bolt, screw, rivet, solder, weld, glue, form over, layer, etch, and other like terms. The phrases "mounted on" and "mounted to" include any interior or exterior portion of the element referenced. As used herein, the mounting may be a direct mounting between the referenced components or an indirect mounting through intermediate components between the referenced components.

Figure 4:
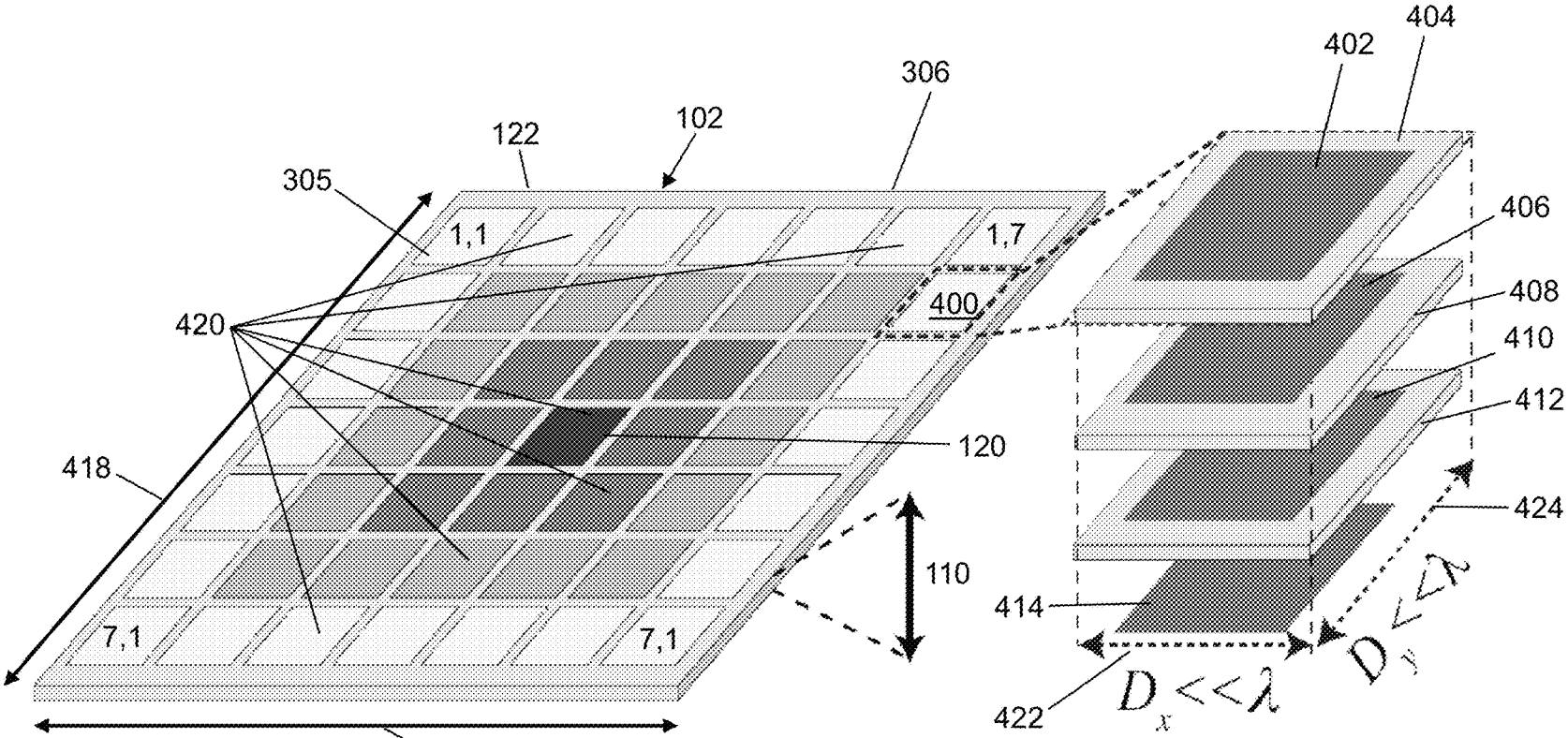
FIG. 4 depicts a pixel structure of the lens structure of FIG. 3 in accordance with an illustrative embodiment.

With reference to FIG. 4, second 2-D grid of capacitive patches 305 is shown in accordance with an illustrative embodiment. In the illustrative embodiment, second 2-D grid of capacitive patches 305 includes a plurality of pixels 420 arranged in a square grid though other grid shapes such as circular may be used in alternative embodiments. The plurality of pixels 420 of second 2-D grid of capacitive patches 305 forms a seven by seven grid of capacitive patches. An upper left grid position may be referenced as 1,1; an upper right grid position may be referenced as 1,7;

a lower left grid position may be referenced as 7,1; and a lower right grid position may be referenced as 7,7. Thus, center 120 of front surface 106 may be referenced as grid position 4,4 of the plurality of pixels 420 that form second 2-D grid of capacitive patches 305.

The grids of first 2-D grid of capacitive patches 316, second 2-D grid of capacitive patches 305, third 2-D grid of capacitive patches 308, and fourth 2-D grid of capacitive patches 312 are aligned to form a time delay circuit at each grid position of the aligned 2-D grids. For example, a pixel 400 of the plurality of pixels 420 may be formed in first sheet layer 300, second sheet layer 302, third sheet layer 304, and first 2-D grid of capacitive patches 316. Thus, pixel 400 includes a first capacitive patch 402, a second capacitive patch 406, a third capacitive patch 410, and a fourth capacitive patch 414. Pixel 400 further includes a first dielectric patch 404, a second dielectric patch 408, and a third dielectric patch 412. First capacitive patch 402 is directly mounted on a front surface of first dielectric patch 404. Fourth capacitive patch 414 is directly mounted on a back surface of third dielectric patch 412. Second capacitive patch 406 is directly mounted on a front surface of second dielectric patch 408 and is directly mounted on a back surface of first dielectric patch 404. Third capacitive patch 410 is directly mounted on a front surface of third dielectric patch 412 and is directly mounted on a back surface of second dielectric patch 408.

In the illustrative embodiment of FIG. 4, lens 102 has a width 416 and a length 418 that are equal and correspond to aperture length 112. First capacitive patch 402, second capacitive patch 406, third capacitive patch 410, and fourth capacitive patch 414 fit within the dimensions of first dielectric patch 404, second dielectric patch 408, and third dielectric patch 412. First dielectric patch 404, second dielectric patch 408, and third dielectric patch 412 have a width dimension 422 and a length dimension 424. Thickness 110, width dimension 422, and length dimension 424 of pixel 400 are typically less than a minimum $\lambda_c$ defined for the frequency band of interest for transmitter 100. For example, thickness 110, width dimension 422, and length dimension 424 are typically less than 1.0, 0.5, and 0.5, respectively, of the minimum $\lambda_c$ selected for transmission by transmitter 100. Though in the illustrative embodiment, pixel 400 has a rectangular shape pixel 400 may be circular, elliptical, or form other polygonal shapes.

As stated previously, each pixel of the plurality of pixels 420 forms a time delay circuit based on the arrangement of capacitive patch layers and dielectric sheet layers selected to form lens 102. For example, with reference to FIG. 5, an equivalent circuit 500 for pixel 400 is shown in accordance with an illustrative embodiment. Equivalent circuit 500 includes a first capacitor $C_1$ associated with a capacitance created by first capacitive patch 402, a second capacitor $C_2$ associated with a capacitance created by second capacitive patch 406, a third capacitor $C_3$ associated with a capacitance created by third capacitive patch 410, and a fourth capacitor $C_4$ associated with a capacitance created by fourth capacitive patch 414 arranged in parallel as shunt capacitors.

Equivalent circuit 500 further includes a first transmission line with characteristic impedance $Z_1$ and length $h_1$ associated with first dielectric patch 404, a second transmission line with characteristic impedance $Z_2$ and length $h_2$ associated with second dielectric patch 408, and a third transmission line with characteristic impedance $Z_3$ and length $h_3$ associated with third dielectric patch 412 arranged in series between the shunt capacitors associated with the adjacent capacitive patch(es). Thus, equivalent circuit 500 acts as a low pass filter that is implemented at each pixel of the plurality of pixels 420 to form a true time delay, low pass circuit. More specifically, equivalent circuit 500 acts as a 7th order low pass filter as a result of the number of capacitive patch layers, four, and dielectric sheet layers, three, that form each pixel.

To achieve different time delays over the desired frequency range, the plurality of pixels 420 can be designed to have linear transmission phases with different slopes. The steeper the slope of the transmission phase, the larger the time delay it will provide. The group delay is determined by several factors including both the order of the filter and the fractional bandwidth.

Figure 6:
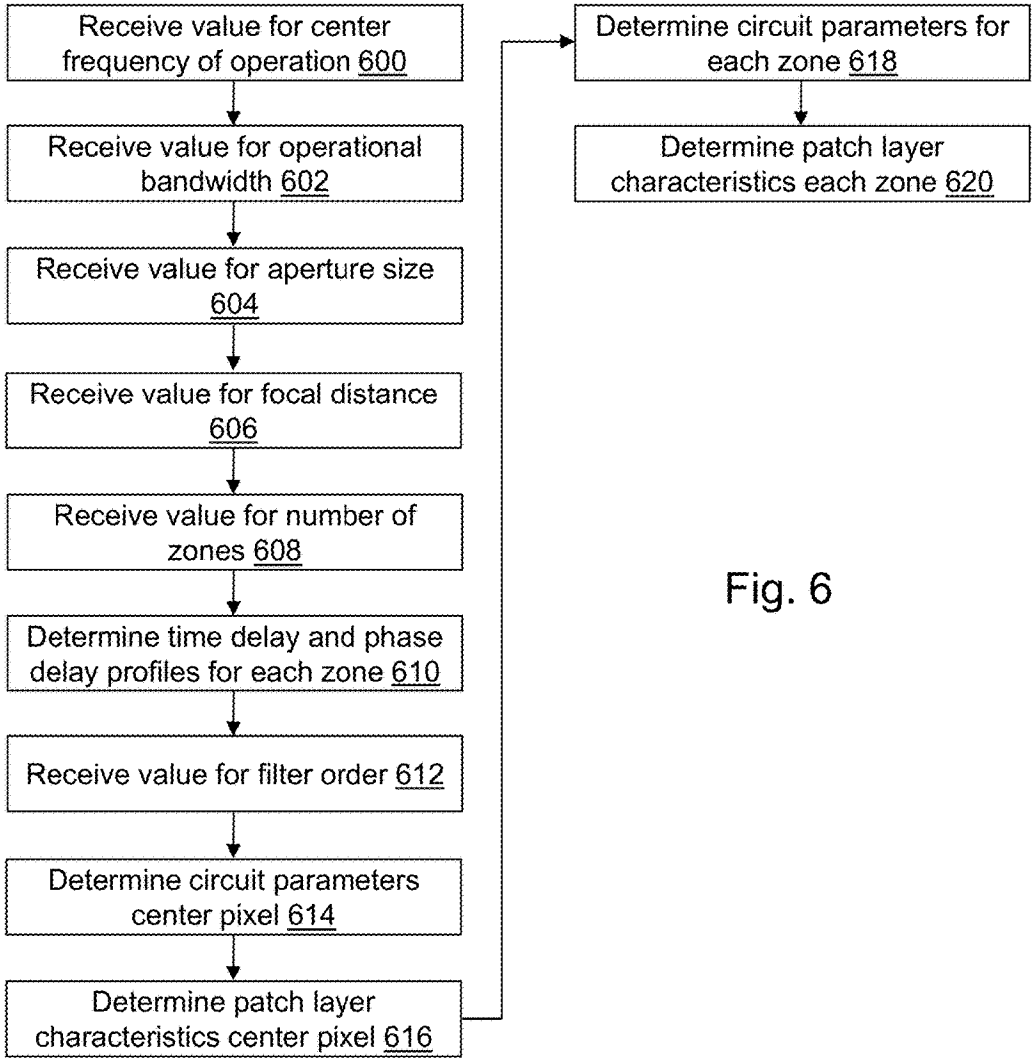
FIG. 6 depicts a flow diagram illustrating example operations performed in designing the lens structure of FIG. 3 in accordance with an illustrative embodiment.

With reference to FIG. 6, operations associated with designing lens 102 are described in accordance with an illustrative embodiment. The operations may be performed by a lens design application 718 shown with reference to FIG. 7. Additional, fewer, or different operations may be performed depending on the embodiment. The order of presentation of the operations of FIG. 6 is not intended to be limiting. Thus, although some of the operational flows are presented in sequence, the various operations may be performed in various repetitions, concurrently, and/or in other orders than those that are illustrated.

Lens 102 is assumed to be located in an x-y plane where x is defined in the width 416 direction and y is defined in the length 418 direction. Lens 102 is further assumed to have a circular aperture with diameter of D as described with reference to FIG. 1. The travel time it takes for the wave originated at focal point 104 to arrive at an arbitrary point on front surface 106 of lens 102 with coordinates (x,y,z=0) is calculated as:

$$T(x,y,z=0)=\sqrt{x^2+y^2+f_d^2}/c$$

where $0<\sqrt{x^2+y^2}<D/2$. The time delay profile that needs to be provided by the lens can be calculated as:

$$TD(x,y,z=h)=(\sqrt{(D/2)^2+f_d^2}-r)/c+t_0 \quad (1)$$

where $r=\sqrt{x^2+y^2+f_d^2}$ and $t_0>0$ is an arbitrary constant, which represents a constant time delay added to the response of every pixel of the plurality of pixels 420 of lens 102. The phase profile at the operating frequency can be calculated from:

$$\Phi(x,y)=k_0(\sqrt{(D/2)^2+f_d^2}-r)+\Phi_0 \quad (2)$$

where $\Phi_0$ is a positive constant that represents a constant phase delay added to the response of every pixel of the plurality of pixels 420 of lens 102, $k_0=2\pi/\lambda_0$ is the free space wave number, $\lambda_0$ is the free space wavelength, and $r=\sqrt{x^2+y^2+f_d^2}$ is the distance between an arbitrary point on the aperture of lens 102 specified by its coordinates (x, y, z=0) and the focal point of lens 102 (x=0, y=0, $z=-f_d$).

To ensure that output surface 108 of lens 102 represents an equiphase and an equi-delay surface, two conditions are satisfied across the aperture. First, the time delay profile provided for each pixel calculated from equation (1) is approximately the same over the desired band of operation. Second, the phase shift profile at the operating frequency is approximately equal to that calculated from equation (2). Satisfying these two conditions ensures that the signal carried by the incident wave is not distorted. Moreover, it ensures that planar wave 118 at the output of lens 102 is spatially coherent over the desired frequency range. Equation (1) is essentially the negative derivative of equation (2) with respect to the frequency, which is expected since, by definition, the group delay is defined as the negative derivative of the phase with respect to the frequency. Therefore, satisfying the phase condition in equation (2) at each frequency point within the desired frequency range automatically leads to the satisfaction of equation (1).

With reference to FIG. 6, in an operation 600, a desired center frequency of operation is received. For example, a user may execute lens design application 718 which causes presentation of a first user interface window, which may include a plurality of menus and selectors such as drop down menus, buttons, text boxes, hyperlinks, additional windows, etc. associated with lens design application 718. The user, for example, may enter the frequency into a text box or select the frequency from a drop down menu. As understood by a person of skill in the art, the first user interface window is presented on a display 714 (shown with reference to FIG. 7) under control of the computer-readable and/or computer-executable instructions of lens design application 718 executed by a processor 708 (shown with reference to FIG. 7) of a lens design system 700 (shown with reference to FIG. 7). As the user interacts with the first user interface presented by lens design application 718, different user interface windows may be presented to provide the user with more or less detailed information related to designing lens 102. Thus, as known to a person of skill in the art, lens design application 718 receives an indicator associated with an interaction by the user with a user interface window presented under control of lens design application 718. Based on the received indicator, lens design application 718 performs one or more operations.

In an operation 602, an operational bandwidth for lens 102 is received. For example, the user may enter the bandwidth into a text box or select the bandwidth from a drop down menu. In an operation 604, a desired size of the aperture of lens 102 is received. For example, for lens 102 having a circular shape, the user may enter the diameter D into a text box or select the diameter D from a drop down menu. In an operation 606, a desired focal distance $f_d$ for lens 102 is received. For example, the user may enter the focal distance $f_d$ into a text box or select the focal distance $f_d$ from a drop down menu.

To define the time delay for each pixel of the plurality of pixels 420, the aperture of lens 102 may be divided into M concentric zones with identical pixels populated within each zone. In an operation 608, a number of discrete regions or zones into which to divide the aperture of lens 102 is received. For example, the user may enter the number of zones into a text box or select the number of zones from a drop down menu. In general, the number of pixels, and thus, time delay elements may be selected to provide a time delay profile with as much continuity as possible, which in turn results in time delay elements that are as small as possible compared to the wavelength band of interest.

In an operation 610, a time delay and phase delay profile is determined for each zone using equations (3) and (4), respectively, below:

$$TD(x_m,y_m)=(\sqrt{(D/2)^2+f_d^2}-r_m)/c+t_0 \quad (3)$$

$$\Phi(x_m, y_m)=k_0(\sqrt{(D/2)^2+f_d^2}-r_m)+\Phi_0 \quad (4)$$

where $r_m=\sqrt{x_m^2 y_m^2+f_d^2}$, and where $x_m,y_m$ are the distances to the center of each zone and where m=0,1, . . . ,M−1.

The number of capacitive patch layers and dielectric sheet layers that form each pixel may be selected based on the filter order selected to achieve the maximum time delay. In an operation 612, a desired filter order for lens 102 is received. For example, the user may enter the filter order into a text box or select the filter order from a drop down menu. Alternatively, lens design application 718 may automatically calculate the filter order of each pixel based on the maximum time delay and phase delay.

The time delay provided by each pixel is a function of the order of the filter and its bandwidth. Decreasing the bandwidth of the filter or increasing the order of the filter increases the time delay achievable from it. In this design application, the time delay from the lens and the bandwidth of the lens are known. Most microwave filter design handbooks have tables and figures that show the group delay responses of standard low-pass filters with different response types and orders. Once the required time delay from each pixel and the desired bandwidth of the lens are determined, the minimum order of the filter that provides the required time delay can be determined by checking these standard filter responses. Any order higher than this minimum order also satisfies the response for the lens design. Alternatively, the filter order can be determined using computer simulations of equivalent circuit model 500. The order of the filter can initially be estimated and the response of the equivalent circuit model 500 simulated based on the estimate. Based on the simulated response, the order of the filter can be increased or decreased as necessary and the simulation process repeated to obtain the exact minimum order of the filter that provides a desired group delay. The number of dielectric sheet layers used to form each pixel of the plurality of pixels 420 is defined as the desired filter order minus one and divided by two.

In an operation 614, the equivalent circuit capacitance and transmission line and length values are defined to achieve the maximum time delay and phase delay profile defined for the center pixel of lens 102 given the desired filter order. In an operation 616, the characteristics of each dielectric patch and of each capacitive patch of the center pixel is calculated to provide a linear transmission phase with the steepest slope (or largest time delay) over the selected operational bandwidth. In an operation 618, the equivalent circuit capacitance and transmission line impedance, and length values are defined to achieve the time delay and phase delay profile defined for each zone in equations (3) and (4), respectively, given the desired filter order.

In an operation 620, the characteristics of each dielectric patch and of each capacitive patch of the pixels in each zone are calculated to provide the time delay and phase delay profile defined for each zone in equations (3) and (4), respectively. The most important factor in the design of each pixel of the plurality of pixels 420 is the desired time-delay required from it. The time delay that a pixel is configured to provide can be calculated as described previously. Once this time-delay is known the frequency-dependent phase delay that the pixel is configured to provide can be determined, for example, as shown with reference to FIG. 8. The design process for each pixel starts with determining the parameters of the equivalent circuit model shown in FIG. 5. These include the values of the capacitors, the lengths of the transmission lines, and the characteristic impedance values of the transmission lines. The characteristic impedance values of the transmission lines are related to the dielectric constant values of the dielectric substrates used in the lens. The equivalent circuit model 500 is designed to provide a transmission phase which closely matches the required frequency-dependent transmission phase (or required time-delay) from the pixel. This design process can be accomplished following the well-known microwave filter design techniques and with the aid of computer aided design (CAD)

tools to simulate the response of the equivalent circuit model 500 to ensure that the desired phase response is achieved.

Figure 5:
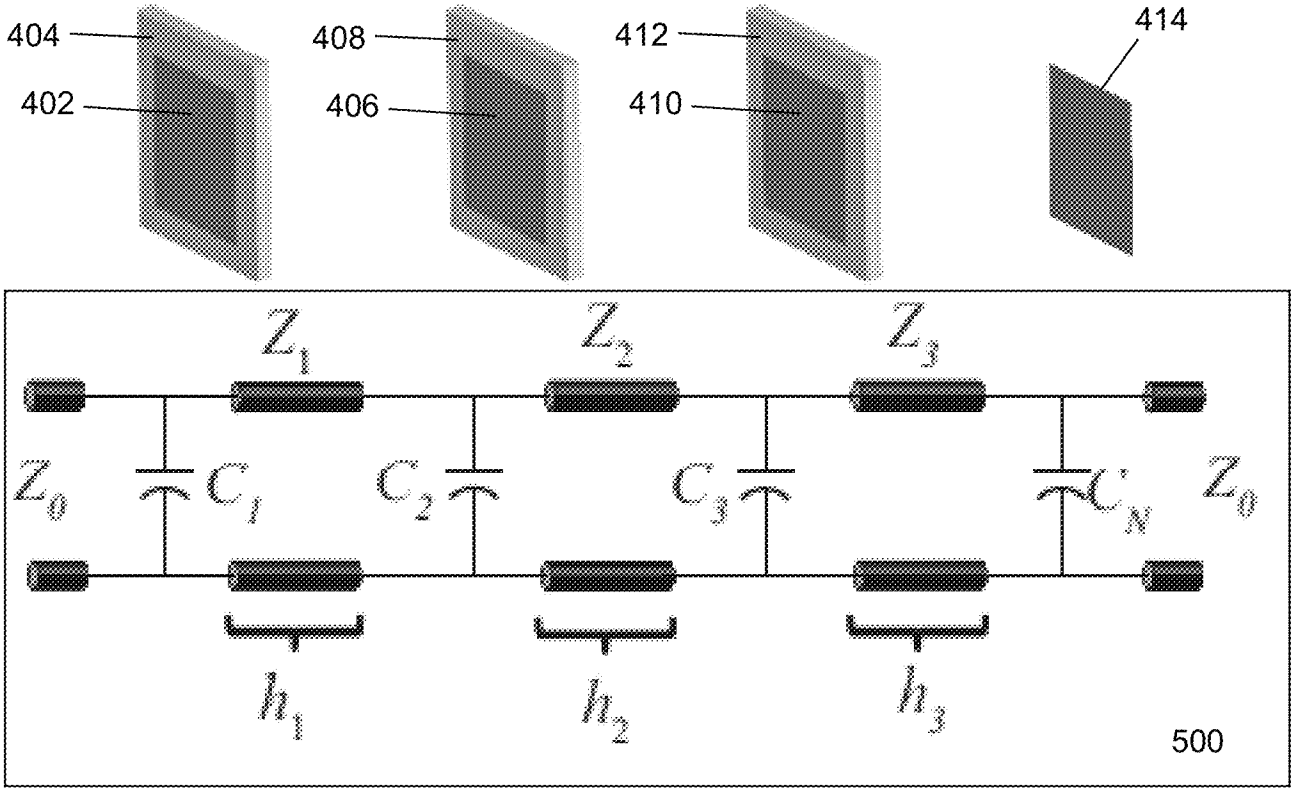
FIG. 5 depicts an equivalent circuit for the pixel structure of FIG. 4 in accordance with an illustrative embodiment.

As part of this design process, the designer has the freedom of choosing the dielectric constant of the dielectric substrates used (e.g. first dielectric patch 404, second dielectric patch 408, and third dielectric patch 412 in FIG. 5). This determines the type of the material that can be employed. Commercially available dielectric substrates can usually be used for this purpose (e.g. Roger 5580 from Rogers Corporation). Once the complete parameters of the equivalent circuit model 500 are determined, these values are mapped to the physical parameters of the pixel such as pixel 400. The thicknesses of the transmission lines used in the equivalent circuit model 500 are the same as the thicknesses of first dielectric patch 404, second dielectric patch 408, and third dielectric patch 412. The last remaining item is to determine the physical dimensions of the capacitive patches used in each pixel. The designer has some flexibility in choosing the dimensions of each pixel (422 and 424 in FIG. 4). Once these dimensions are determined, the dimensions of first capacitive patch 402, second capacitive patch 406, third capacitive patch 410, and fourth capacitive patch 414 are determined. Assuming that width dimension 422 and a length dimension 424 are equal, the initial dimensions of first capacitive patch 402, second capacitive patch 406, third capacitive patch 410, and fourth capacitive patch 414 can be determined from the following approximate formula:

$$C = \varepsilon_0 \varepsilon_{eff} \frac{2D}{\pi} \ln \frac{1}{\sin \pi s / 2D} \tag{5}$$

where $\varepsilon_0 = 9.85 \times 10^{-12}$, is the permittivity of free space, $\varepsilon_{eff}$ is the effective permittivity of the dielectric substrates that surround each capacitive patch, D is length dimension 422, s is the difference between the length of a square capacitive patch and length dimension 422, and C is a capacitance value of equivalent circuit model 500. In equation (5), the values of all parameters other than s are known. Therefore, the above formula can be used to determine the value of s and therefore, the physical dimensions of each capacitive patch used in the formation of a pixel of lens 102 such as pixel 400. This formula, however, is approximate. Therefore, the physical dimensions predicted by equation (5) can be fine tuned using full-wave electromagnetic (EM) simulations with the initial dimensions obtained from equation (5) used as the initial values in a full-wave EM simulation. The response of each pixel is simulated to ensure that it provides the desired transmission phase response provided by the equivalent circuit model 500.

If a non-square capacitive patch is used or if the physical dimensions of each pixel are not equal to each other, the above formula cannot be used. In such cases, for example, for a circular shaped capacitive patch, the dimensions of the structure may be optimized using a full-wave EM simulation. In this case, the response of an individual pixel is simulated as part of an infinite periodic structure and its transmission phase and transmission magnitude are calculated. The physical dimensions of the structure are modified as necessary to ensure that the transmission phase and magnitude responses obtained from the full-wave EM simulation match those obtained from the equivalent circuit model 500. In general, any shape of a pixel (rectangular, square, circular, elliptical, etc.) may be used.

Figure 7:
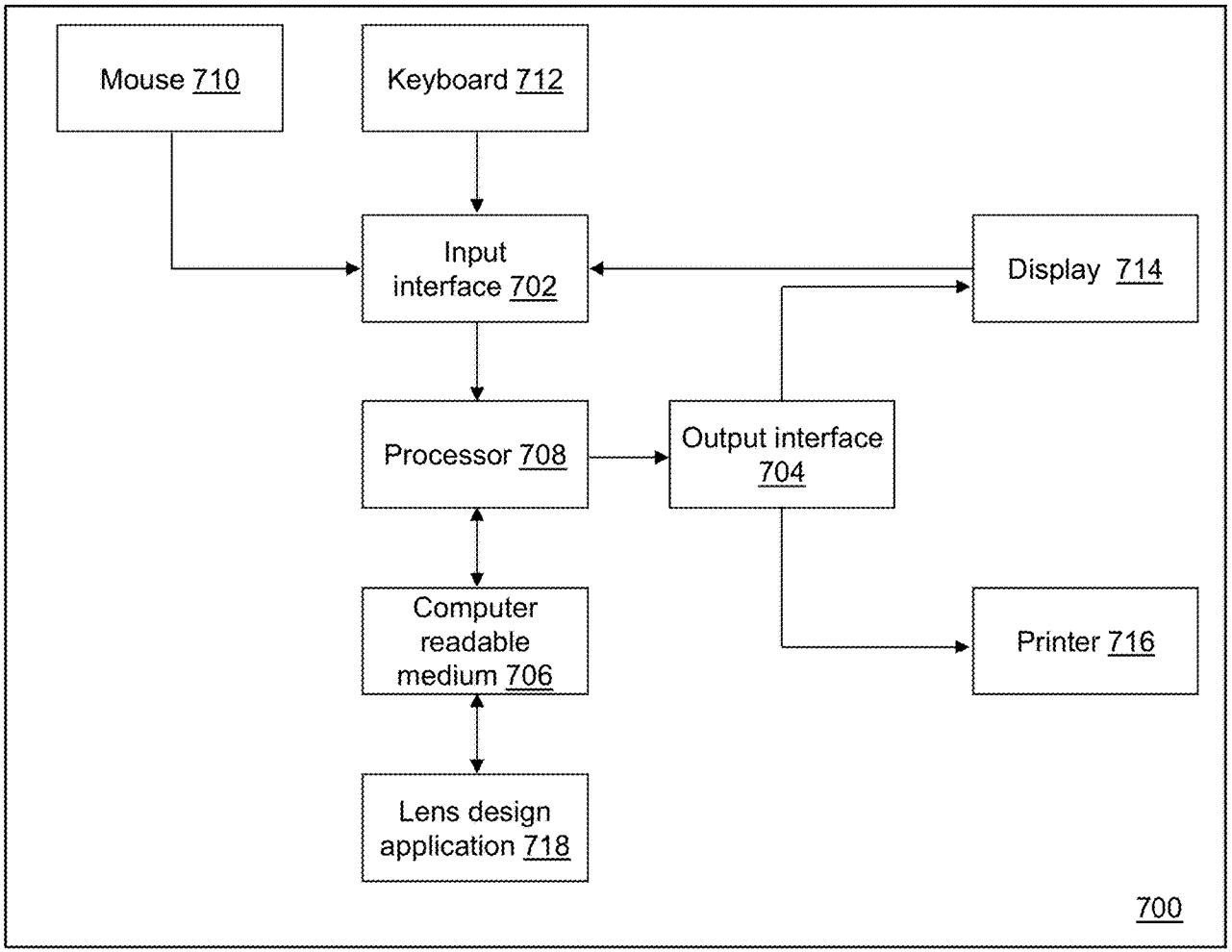
FIG. 7 depicts a block diagram of a lens design system in accordance with an illustrative embodiment.

With reference to FIG. 7, a block diagram of lens design system 700 is shown in accordance with an illustrative embodiment. Lens design system 700 may be a computing device of any form factor such as a personal digital assistant, a desktop, a laptop, an integrated messaging device, a smart phone, a tablet computer, etc. In an illustrative embodiment, lens design system 700 may include an input interface 702, an output interface 704, a computer-readable medium 706, and processor 708. Fewer, different, and additional components may be incorporated into lens design system 700.

Input interface 702 provides an interface for receiving information from the user for entry into lens design system 700 as known to those skilled in the art. Input interface 702 may interface with various input technologies including, but not limited to, a mouse 710, a keyboard 712, display 714, a track ball, a keypad, one or more buttons, etc. to allow the user to enter information into lens design system 700 or to make selections presented in a user interface displayed on display 714. The same interface may support both input interface 702 and output interface 704. For example, display 714 comprising a touch screen both allows user input and presents output to the user. Lens design system 700 may have one or more input interfaces that use the same or a different input interface technology. The input devices further may be accessible by lens design system 700 through a communication interface (not shown).

Output interface 704 provides an interface for outputting information for review by a user of lens design system 700. For example, output interface 704 may interface with various output technologies including, but not limited to, display 714, a printer 716, etc. Lens design system 700 may have one or more output interfaces that use the same or a different interface technology. The output devices further may be accessible by lens design system 700 through the communication interface.

Computer-readable medium 706 is an electronic holding place or storage for information so that the information can be accessed by processor 708 as known to those skilled in the art. Computer-readable medium 706 can include, but is not limited to, any type of random access memory (RAM), any type of read only memory (ROM), any type of flash memory, etc. such as magnetic storage devices (e.g., hard disk, floppy disk, magnetic strips, . . . ), optical disks (e.g., CD, DVD, . . . ), smart cards, flash memory devices, etc. Lens design system 700 may have one or more computer-readable media that use the same or a different memory media technology. Lens design system 700 also may have one or more drives that support the loading of a memory media such as a CD or DVD.

Processor 708 executes instructions as known to those skilled in the art. The instructions may be carried out by a special purpose computer, logic circuits, or hardware circuits. Thus, processor 708 may be implemented in hardware, firmware, or any combination of these methods and/or in combination with software. The term "execution" is the process of running an application or the carrying out of the operation called for by an instruction. The instructions may be written using one or more programming language, scripting language, assembly language, etc. Processor 708 executes an instruction, meaning that it performs/controls the operations called for by that instruction. Processor 708 operably couples with input interface 702, with output interface 704, and with computer-readable medium 706. Processor 708 may retrieve a set of instructions from a permanent memory device and copy the instructions in an executable form to a temporary memory device that is generally some form of RAM. Lens design system 700 may include a plurality of processors that use the same or a different processing technology.

Lens design application 718 performs operations associated with designing lens 102. For example, lens design application 718 is configured to perform one or more of the operations described with reference to FIG. 6. The operations may be implemented using hardware, firmware, software, or any combination of these methods. With reference to the example embodiment of FIG. 7, lens design application 718 is implemented in software (comprised of computer-readable and/or computer-executable instructions) stored in computer-readable medium 706 and accessible by processor 708 for execution of the instructions that embody the operations of lens design application 718. Lens design application 718 may be written using one or more programming languages, assembly languages, scripting languages, etc. Lens design application 718 may be implemented as a Web application.

A prototype lens was designed and simulated. The prototype lens had a circular aperture with a diameter D of 16.2 cm. The prototype lens was designed to operate over the frequency range of 6 to 10 GHz, with 16 concentric zones (M=16) and a focal length $f_d$ of 24 cm corresponding to a $f_d/D$ ratio of 1.5. The maximum time delay variation over the aperture of the prototype lens was calculated to be 40 picoseconds. Such a delay variation range can be achieved by a seventh-order low pass true time delay pixel designed to have a linear transmission phase across the frequency of interest. The unit cell of a seventh-order true time delay pixel is composed of four capacitive layers separated from one another by three thin dielectric substrates as shown and described with reference to FIG. 4. The total thickness of this seventh-order true time delay unit was approximately one cm. The thickness was determined from the transmission line length shown in the equivalent circuit model in FIG. 5. In order to accommodate the design to the commercially available substrate thicknesses, Rogers 5880 substrate with thickness of 3.175 mm was used to model each transmission line in FIG. 5. Considering the Rogers 4450F bonding layer with the thickness of 0.101 mm between the adjacent Rogers 5880 substrates, the total thickness of the true time delay pixel was ~1 cm. The different time delays were achieved by tuning capacitive patch sizes within each capacitive patch layer. With M=16 and $$\frac{f_d}{D} = 1.5,$$

eacn zone is popuiatea by pixels of the same type with a unit cell dimension of 6×6 millimeters.

The predicted frequency response of the pixels was based on the assumption that the pixels operate in a 2-D periodic fashion though this is generally not true since the lens is inherently non-periodic. However, a local periodic assumption is still a valid approach in predicting the performance of the prototype lens. Following the design procedures described with reference to FIG. 6, the time delay and phase shift values are calculated for each zone. The maximum group delay provided by the center pixel corresponded to a steepest linear transmission phase with the largest slope in the desired frequency range.

The pixels of zone 1 were optimized in a way such that the transmission phase of zone 1 was in as close proximity to this steepest linear transmission phase as possible within the desired frequency range. This optimization was carried out by a full-wave simulation executed using the CST Microwave Studio® 3D electromagnetic simulation application developed by CST Computer Simulation Technology AG. The pixel structure defined for zone 1 was placed in a waveguide surrounded by periodic boundary conditions. The structure was excited by a plane wave and the transmission phase and magnitude were calculated.

The design parameters for the pixel structure defined for zone 1 was used as a reference for designing the pixel structures for the remaining zones, which have different group delays and different phase shifts. This was done by de-tuning the capacitive patch sizes of the design parameters for the pixel structure defined for zone 1 such that a linear transmission phase with different slopes could be achieved.

The magnitude and phase responses of each pixel structure were functions of angle and the polarization of incidence of the electromagnetic wave. Because all of the pixel structures operated over relatively small incidence angles (less than 20°), they provided almost identical phase responses under oblique incidence angles for the transverse electric and transverse magnetic polarizations.

Figure 8:
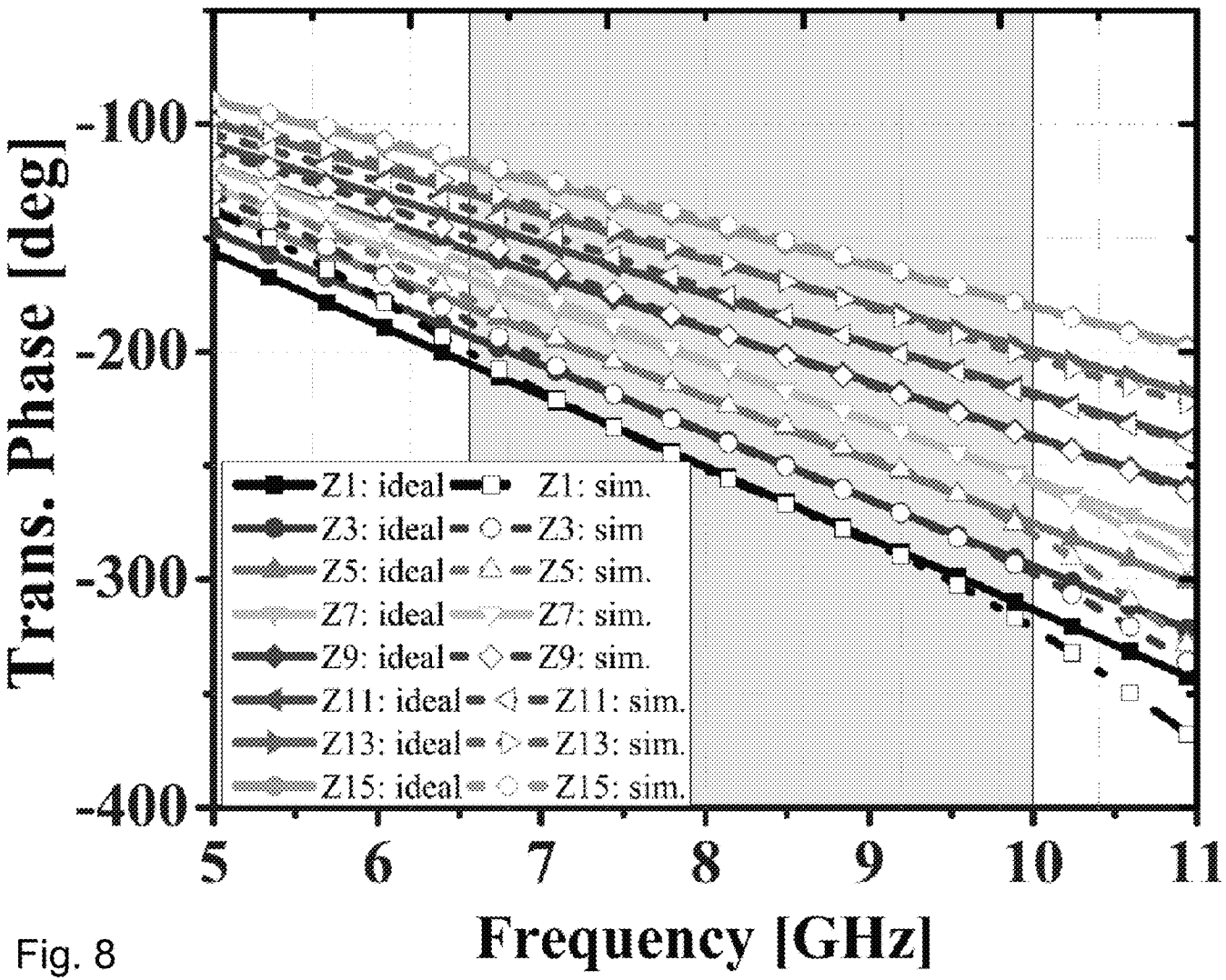
FIG. 8 shows a comparison between a full-wave simulated transmission phase and an ideal linear transmission phase for different zones of a lens prototype having the structure of the lens structure of FIG. 3 in accordance with an illustrative embodiment.

The desired time delay values for each zone corresponded to ideal linear transmission phases with different slopes as shown with reference to FIG. 8. The highlighted region (from 6.5 to 10 GHz) is the desired frequency range of operation. The full-wave simulated transmission phase for each zone was optimized to a close proximity resulting in ~±5° variation in comparison to the ideal linear phase as shown with reference to FIG. 8.

Figure 9:
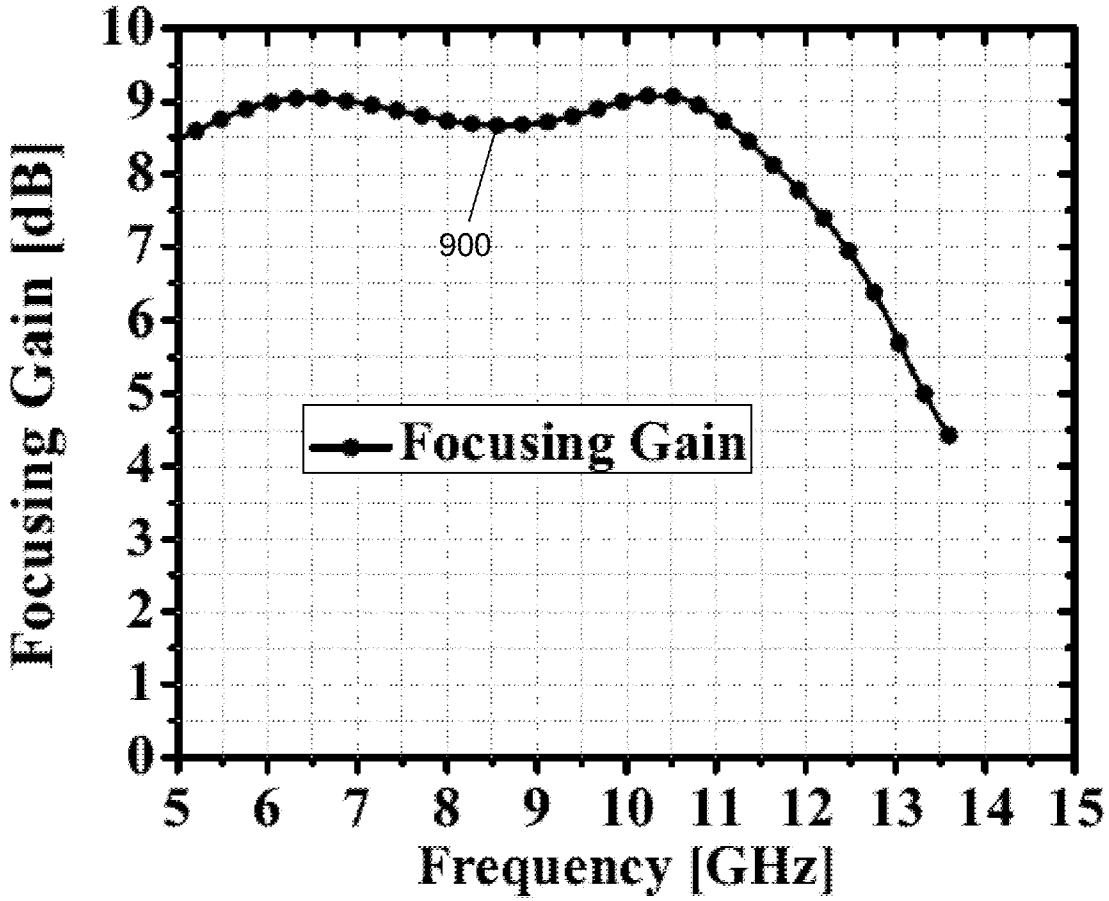
FIG. 9 shows the expected focusing gain of the lens prototype in accordance with an illustrative embodiment.

With reference to FIG. 9, the expected focusing gain of the prototype lens is shown. As demonstrated by a focusing gain curve 900 shown in FIG. 9, the prototype lens had a potentially wideband operation from approximately 5 GHZ to 11.5 GHz. An antenna with a fractional bandwidth larger than 10% can be considered to be a wideband antenna, where the fractional bandwidth is the percentage of the antenna's actual bandwidth with respect to its center frequency of operation. For example, an antenna (or lens) working from 9.5 to 10.5 GHz having a 1 GHz bandwidth and a center frequency of operation of 10.0 GHz has a fractional bandwidth of 10% and can be classified as providing a wideband signal. The expected near field focusing property was also numerically examined. The measured focal point of the prototype lens stayed constant over the desired 6 to 10 GHz operational band.

Figure 10:
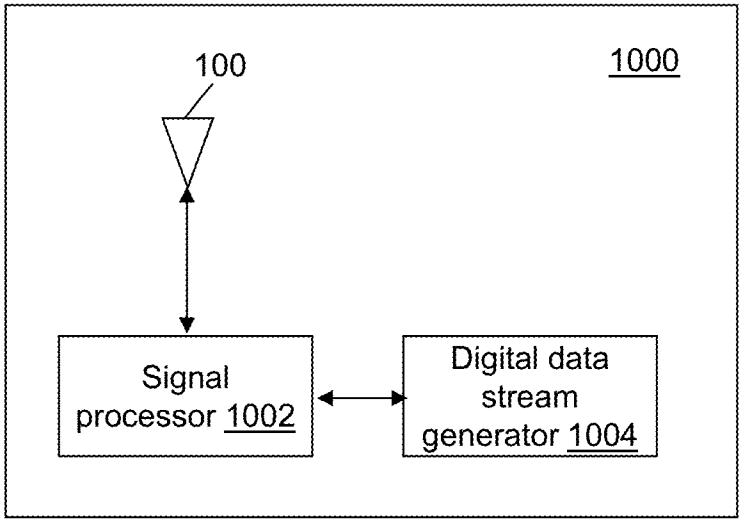
FIG. 10 depicts a block diagram of a transmitter system incorporating the transmitter of FIG. 1 in accordance with an illustrative embodiment.

FIG. 10 shows a block diagram of a transmitter system 1000 in accordance with an illustrative embodiment. Transmitter system 1000 may include transmitter 100, a signal processor 1002, and a digital data stream generator 1004. Different and additional components may be incorporated into transmitter system 1000. Transmitter 100 may include a plurality of electromagnetic wave feed elements arranged to form a uniform or a non-uniform linear array, a rectangular array, a circular array, a conformal array, etc. In an illustrative embodiment, the plurality of electromagnetic wave feed elements are mounted on a focal surface (1-D or 2-D) relative to lens 102.

Signal processor 1002 forms an analog signal or a digital signal that is sent to transmitter 100. The digital signal may be modulate on an RF carrier. Signal processor 1002 may be implemented as a special purpose computer, logic circuits, or hardware circuits and thus, may be implemented in hardware, firmware, software, or any combination of these methods. Signal processor 1002 may receive data streams in analog or digital form. Signal processor 1002 may implement a variety of well-known processing methods, collectively called space-time coding techniques, which can be used for encoding information into digital inputs. Signal processor 1002 further may perform one or more of converting a data stream from an analog to a digital form and vice versa, encoding the data stream, modulating the data stream, up-converting the data stream to a carrier frequency, performing error detection and/or data compression, Fourier transforming the data stream, inverse Fourier transforming the data stream, etc. In a receiving device, signal processor 1002 determines the way in which the signals received by transmitter 100, acting as a receiver, are processed to decode the transmitted signals from a transmitting device, for example, based on the modulation and encoding used at the transmitting device.

Digital data stream generator 1004 may be an organized set of instructions or other hardware/firmware component that generates one or more digital data streams for transmission wirelessly to a receiving device. The digital data streams may include any type of data including voice data, image data, video data, alpha-numeric data, etc.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise.

The foregoing description of illustrative embodiments of the invention have been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A lens comprising:

a first two-dimensional (2-D) grid of capacitive patches; and a first sheet layer comprising a dielectric sheet comprising a front surface and a back surface, wherein the first 2-D grid of capacitive patches is mounted directly on the back surface of the dielectric sheet; and a second 2-D grid of capacitive patches mounted directly on the front surface of the dielectric sheet;

wherein the first 2-D grid of capacitive patches is aligned with the second 2-D grid of capacitive patches to form a time delay circuit at each grid position of the aligned 2-D grids that acts as a low pass filter.

2. The lens of claim 1, further comprising:

a second dielectric sheet comprising a front surface and a back surface, the back surface of the second dielectric sheet mounted directly on a front surface of the second 2-D grid of capacitive patches opposite the dielectric sheet; and a third 2-D grid of capacitive patches mounted directly on the front surface of the second dielectric sheet;

wherein the third 2-D grid of capacitive patches is aligned with the second 2-D grid of capacitive patches to further form the time delay circuit at each grid position of the aligned 2-D grids.

3. The lens of claim 1, further comprising:

a plurality of additional sheet layers, wherein each sheet layer of the plurality of additional sheet layers comprises a second dielectric sheet comprising a front surface and a back surface; and a third 2-D grid of capacitive patches mounted directly on the front surface of the second dielectric sheet;

wherein the third 2-D grid of capacitive patches is aligned with the second 2-D grid of capacitive patches to further form the time delay circuit at each grid position of the aligned 2-D grids that acts as the low pass filter; and further wherein the back surface of the second dielectric sheet of each sheet layer of the plurality of additional sheet layers is mounted directly on a front surface of a 2-D grid of capacitive patches of a previous sheet layer that includes the first sheet layer.

4. The lens of claim 3, wherein a filter order of the low pass filter is defined as $2*N_{TS}+1$, where $N_{TS}$ is a number of the plurality of additional sheet layers plus one.

5. The lens of claim 4, wherein dimensions of the first 2-D grid of capacitive patches, the second 2-D grid of capacitive patches, and the third 2-D grid ofcapacitive patches of each sheet layer of the plurality of additional sheet layers are configured to provide a predetermined time delay at each grid position based on a capacitance value provided by each capacitive patch of the first 2-D grid of capacitive patches, the second 2-D grid of capacitive patches, and the third 2-D grid of capacitive patches of each sheet layer of the plurality of additional sheet layers.

6. The lens of claim 5, wherein a dielectric constant and a thickness of the dielectric sheet and the second dielectric sheet of each sheet layer of the plurality of additional sheet layers are further configured to provide the predetermined time delay at each grid position based on a characteristic impedance value provided by each of the dielectric sheet and of the second dielectric sheet of each sheet layer of the plurality of additional sheet layers.

7. The lens of claim 6, wherein the low pass filter defines an equivalent circuit for the time delay circuit that includes the capacitance value provided by each capacitive patch of the first 2-D grid of capacitive patches, the second 2-D grid of capacitive patches, and the third 2-D grid of capacitive patches of each sheet layer of the plurality of additional sheet layers in parallel between the characteristic impedance value provided by each of the dielectric sheet and of the second dielectric sheet of each sheet layer of the plurality of additional sheet layers.

8. The lens of claim 5, wherein the capacitance value is a function of an effective permittivity of the dielectric sheet and the second dielectric sheet of each sheet layer of the plurality of additional sheet layers that surrounds each capacitive patch of the first 2-D grid of capacitive patches, the second 2-D grid of capacitive patches, and the third 2-D grid of capacitive patches of each sheet layer of the plurality of additional sheet layers.

9. A transmitter comprising:

a lens comprising a first two-dimensional (2-D) grid of capacitive patches; and a first sheet layer comprising a dielectric sheet comprising a front surface and a back surface, wherein the first 2-D grid of capacitive patches is mounted directly on the back surface of the dielectric sheet; and a second 2-D grid of capacitive patches mounted directly on the front surface of the dielectric sheet;

wherein the first 2-D grid of capacitive patches is aligned with the second 2-D grid of capacitive patches to form a time delay circuit at each grid position of the aligned 2-D grids that acts as a low pass filter; and an electromagnetic wave feed element configured to receive a signal, and in response, to radiate a spherical radio wave toward the second 2-D grid of capacitive patches;

wherein the time delay circuit at each grid position of the aligned 2-D grids is selected such that the lens re-radiates the spherical radio wave as a second radio wave.

10. The transmitter of claim 9, wherein the lens further comprises:

a second dielectric sheet comprising a front surface and a back surface, the back surface of the second dielectric sheet mounted directly on a front surface of the second 2-D grid of capacitive patches opposite the dielectric sheet; and a third 2-D grid of capacitive patches mounted directly on the front surface of the second dielectric sheet;

wherein the third 2-D grid of capacitive patches is aligned with the second 2-D grid of capacitive patches to further form the time delay circuit at each grid position of the aligned 2-D grids.

11. The transmitter of claim 9, wherein the lens further comprises:

a plurality of additional sheet layers, wherein each sheet layer of the plurality of additional sheet layers comprises a second dielectric sheet comprising a front surface and a back surface; and a third 2-D grid of capacitive patches mounted directly on the front surface of the second dielectric sheet;

wherein the third 2-D grid of capacitive patches is aligned with the second 2-D grid of capacitive patches to further form the time delay circuit at each grid position of the aligned 2-D grids that acts as the low pass filter; and further wherein the back surface of the second dielectric sheet of each sheet layer of the plurality of additional sheet layers is mounted directly on a front surface of a 2-D grid of capacitive patches of a previous sheet layer that includes the first sheet layer.

12. The transmitter of claim 9, wherein the electromagnetic wave feed element comprises a plurality of electromagnetic wave feed elements configured to receive a plurality of signals, and in response, to radiate a plurality of spherical radio waves toward the second 2-D grid of capacitive patches.

13. The transmitter of claim 9, wherein the signal is a wideband pulsed signal having a fractional bandwidth of greater than 10%.

14. The transmitter of claim 9, wherein the second radio wave is a planar wave.

15. A transmitter system comprising:

a lens comprising a first two-dimensional (2-D) grid of capacitive patches; and a first sheet layer comprising a dielectric sheet comprising a front surface and a back surface, wherein the first 2-D grid of capacitive patches is mounted directly on the back surface of the dielectric sheet; and a second 2-D grid of capacitive patches mounted directly on the front surface of the dielectric sheet;

wherein the first 2-D grid of capacitive patches is aligned with the second 2-D grid of capacitive patches to form a time delay circuit at each grid position of the aligned 2-D grids that acts as a low pass filter;

a signal processor configured to receive a digital data stream and to transform the received digital data stream into an analog signal; and an electromagnetic wave feed element configured to receive the analog signal, and in response, to radiate a spherical radio wave toward the second 2-D grid of capacitive patches;

wherein the time delay circuit at each grid position of the aligned 2-D grids is selected such that the lens re-radiates the spherical radio wave as a second radio wave.

16. The transmitter system of claim 15, wherein the lens further comprises:

a second dielectric sheet comprising a front surface and a back surface, the back surface of the second dielectric sheet mounted directly on a front surface of the second 2-D grid of capacitive patches opposite the dielectric sheet; and a third 2-D grid of capacitive patches mounted directly on the front surface of the second dielectric sheet;

wherein the third 2-D grid of capacitive patches is aligned with the second 2-D grid of capacitive patches to further form the time delay circuit at each grid position of the aligned 2-D grids.

17. The transmitter system of claim 15, wherein the lens further comprises:

a plurality of additional sheet layers, wherein each sheet layer of the plurality of additional sheet layers comprises a second dielectric sheet comprising a front surface and a back surface; and a third 2-D grid of capacitive patches mounted directly on the front surface of the second dielectric sheet;

wherein the third 2-D grid of capacitive patches is aligned with the second 2-D grid of capacitive patches to further form the time delay circuit at each grid position of the aligned 2-D grids that acts as the low pass filter; and further wherein the back surface of the second dielectric sheet of each sheet layer of the plurality of additional sheet layers is mounted directly on a front surface of a 2-D grid of capacitive patches of a previous sheet layer that includes the first sheet layer.

18. The transmitter system of claim 15, wherein the electromagnetic wave feed element comprises a plurality of electromagnetic wave feed elements configured to receive a plurality of signals, and in response, to radiate a plurality of spherical radio waves toward the second 2-D grid of capacitive patches.

19. The transmitter system of claim 15, wherein the signal is a wideband pulsed signal having a fractional bandwidth of greater than 10%.

20. The transmitter system of claim 15, wherein the second radio wave is a planar wave.

* * * * *